US005108125A

United States Patent [19]

Callegari

[11] Patent Number: 5,108,125

[45] Date of Patent: Apr. 28, 1992

[54] INTEGRATED ATTACHMENT FOR CROSS COUNTRY SKIS

[75] Inventor: Mario Callegari, Biadene di Montebelluna, Italy

[73] Assignee: Icaro Olivieri & C. SPA, Montebelluna, Italy

[21] Appl. No.: 398,459

[22] Filed: Aug. 25, 1989

[30] Foreign Application Priority Data

Sep. 19, 1988 [IT] Italy ..... 83479 A/88

[51] Int. Cl.[5] ..... A63C 9/20

[52] U.S. Cl. ..... 280/615

[58] Field of Search ..... 280/614, 615, 611, 628, 280/631, 634, 635

[56] References Cited

U.S. PATENT DOCUMENTS

| | | | |
|---|---|---|---|
| 3,907,319 | 9/1975 | Berlied, Jr. | 280/615 |
| 4,082,312 | 4/1978 | Johnson | 280/615 |
| 4,235,452 | 11/1980 | Linecker | 280/615 |
| 4,553,771 | 11/1985 | Bernard et al. | 280/615 |
| 4,722,613 | 2/1988 | Jungkind | 280/615 |
| 4,743,042 | 5/1988 | Järvinen | 280/615 |

FOREIGN PATENT DOCUMENTS

| | | | |
|---|---|---|---|
| 2626309 | 12/1977 | Fed. Rep. of Germany . | |
| 2937347 | 6/1980 | Fed. Rep. of Germany | 280/615 |
| 2443853 | 7/1980 | France | 280/615 |
| 619147 | 9/1980 | Switzerland . | |

*Primary Examiner*—Andres Kashnikow
*Assistant Examiner*—Richard Camby
*Attorney, Agent, or Firm*—Antonelli, Terry, Stout & Kraus

[57] ABSTRACT

Integrated attachment for cross country skis, which is suitable to connect ski boots (17) to the surface (35) of a cross country ski (34), the ski boot (17) comprising a main anchorage pin (20) clamped resiliently in a slot (25) included in the integrated attachment (10), with which (10) there cooperates a contrast thrust spring means (33), the attachment (10) comprising a support (11) with wings (36) that bear an oscillation pivot (12) positioned at a right angle to the ski (34) and supporting an oscillatory connector (26) with which the ski boot (17) can oscillate vertically, the oscillatory connector (26) extending before and behind the oscillatory pivot (12) and having an L-shaped form with its vertex on the axis of the oscillation pivot (12) situated in a part below the boot (17) and under the front part thereof (17), the contrast thrust spring means (33) opposing the oscillation movement of the oscillatory connector (26) by acting on a first frontal side (127) of a frontal body (27).

12 Claims, 6 Drawing Sheets

INTEGRATED ATTACHMENT FOR CROSS COUNTRY SKIS

Figure 1:
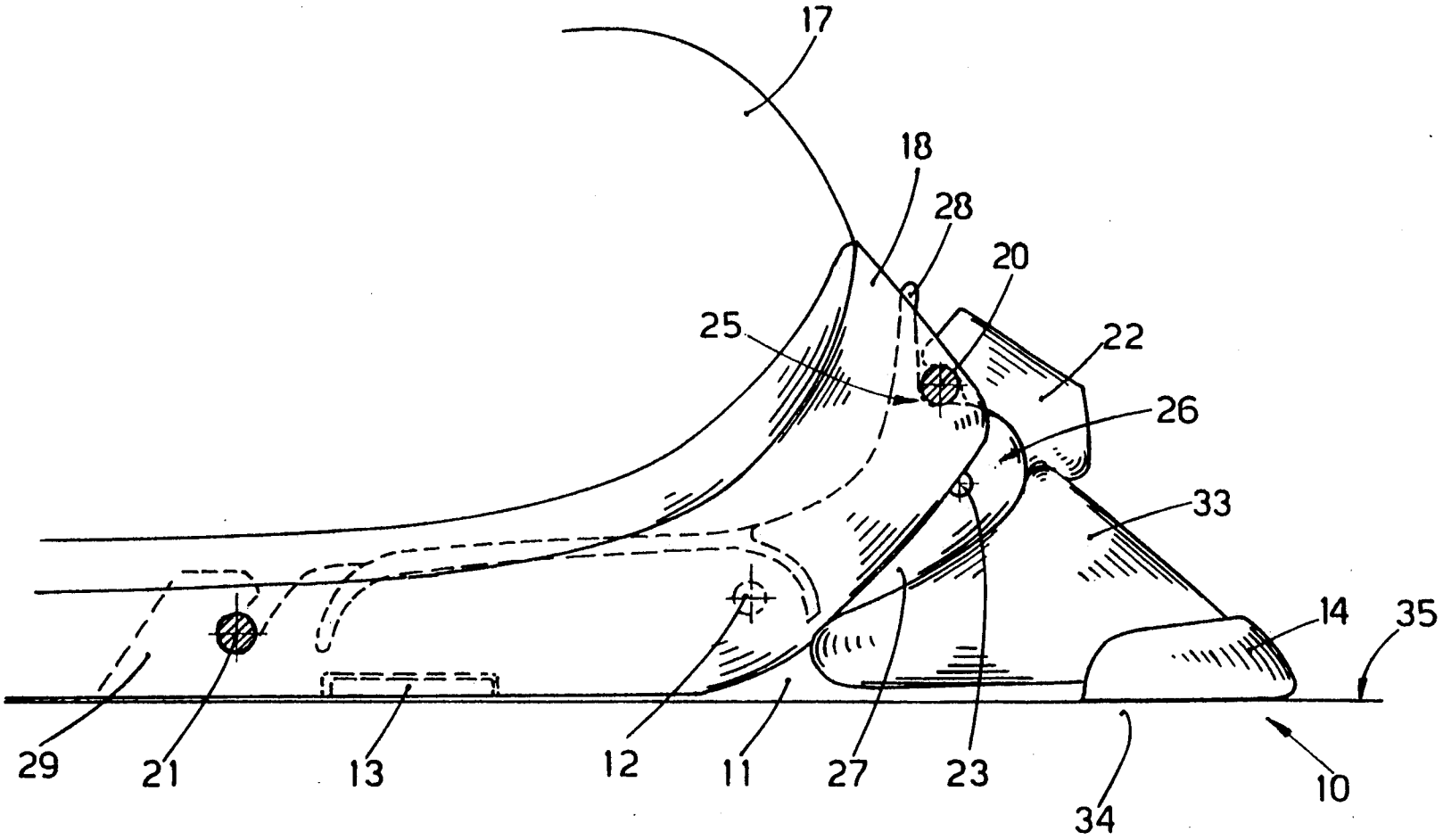

This invention concerns an integrated attachment for cross country skis. To be more exact, the invention concerns an integrated attachment to connect cross country ski boots to cross country skis, the attachment enabling the boots to be guided lengthwise and laterally and to be anchored to the skis without continuity during the lifting of the boots from the skis.

Attachments are known which comprise coordinated systems consisting of a special conformation of the sole and/or heel of a cross country ski boot cooperating with an appropriate anchorage plate fitted to or installed in a cross country ski.

Systems are known in particular which include in the soles of cross country ski boots one or more lengthwise and substantially parallel grooves which cooperate with relative ribs on the anchorage plates.

These known types have developed side by side with the evolution of cross country skiing techniques and have become established together with modern cross country skiing steps.

Among the cross country skiing steps which are of greater and greater interest to skiing fans and sportsmen is the so-called skater's step because of the advantages it confers. This step consists in alternating the directional action on one ski, whereas the thrust action is produced with the other ski, which diverges by a given angle from the direction of advance, with the vertex of the angle upstream, and is caused to run along a given distance towards the outside of the ski track.

This step has the same name as the step performed mainly with a thrust in skating, as the movements are alike in both cases.

However, the skater's step requires a lengthwise control of the ski and at the same time a suitable anchorage of the boot to the ski, so that the lateral thrust at an angle is transmitted fully to the ski and therefore leads to greater stability and speed.

CH PS 619.147 discloses an embodiment which does not enable the thrust to be fully and properly transmitted nor the ski to be properly controlled.

U.S. Pat. Nos. 3,907,319, 4,235,452 and DE 2.626.309 disclose an attachment solution which, if used alone, is unsatisfactory for lateral control of the ski and is worthwhile substantially for the alternating step alone.

U.S. Pat. No. 4,082,312 discloses an attachment which makes lateral control of the ski possible only when the heel of the boot is rested on the ski itself and only provided that no snow has entered between the boot and the ski.

DE 2.937.347 and FR 2.443.853 disclose an attachment which provides a satisfactory lateral control of the ski but raises problems when snow enters between the boot and the ski and therefore does not allow the boot to be fully anchored to the ribs included on the ski.

IT 83360 A/86 discloses an anchorage for the sole of cross country ski boots which consists of grooves cooperating with mating ribs included on the sole of the boot and on a plate included in, or forming part of, a cross country ski, whereby the grooves diverge towards the heel of the boot and the vertex of the groove is located in an area between the attachment of the bridge in the front part of the boot and the toes of the foot of the skier.

This embodiment is satisfactory for a good lateral control of the skis only when the boot is rested on the ski, but not when the boot is lifted to carry out the step, since the guides remain fixed to the ski and the boot is guided only by a connecting point and is always subject to the risk of snow entering between the sole of the boot and the ski.

IT 83374 A/86 discloses a frontal tip for cross country ski boots, whereby the sole is conformed as desired and a cavity is included in the front lower part of the boot and lodges an elongated replaceable element, which in anchored so as to be able to oscillate about a pivot within the cavity, the pivot being positioned at least below the toes of the foot of the user.

This embodiment has brought about an improvement in the use of cross country skis since the attachment is made elasticized and can absorb and restore the thrust forces and at the same time can ensure a good lateral anchorage between the toe-cap and the boot.

All the solutions cited above, however, are unsatisfactory for a plurality of reasons.

They require the inclusion, on the upper face of the ski, of raised elements which cooperate with grooves included in the soles of the boots. These raised elements not only are the cause of installation and maintenance costs but also entail considerable problems of separation of the sole from the guides when there are strong lateral thrusts as in the skater's step, and become useless when the boot is lifted from the ski because, as is well known, these guides are fixed to the ski. In the case of IT 83374 A/86 too the lateral control has to be supplemented with other means as the solution proposed is, in fact, not adequate for prolonged use with the skater's step. Furthermore, the entry of snow creates problems of engagement and correct use.

Moreover, the known proposals entail general and specific problems linked to the weight, dimensions and overall bulk and to the scanty facilities for fitting, maintenance and replacement of the attachments and adaptation thereof to the selected step.

Therefore in the current situation of cross country skiing there are various systems of boots and relative attachments, the special nature of which maximises a perfect relationship between the athletic action and the efficiency of the equipment so as to improve performance in general.

But the athletic technique has outclassed the performance of the equipment by introducing the skater's step.

Improvements or revisions of the equipment have been applied in an attempt to adapt it to the new requirements, but the outcome has been substantially inadequate for the athletic innovations.

The result is that a product is lacking on the market which has been conceived with new criteria able to meet the new requirements in a satisfactory manner.

The greatest problem to be overcome is that of being able to guide the boot in each phase of performance of the athletic action, especially when the foot is separated from the ski.

In all the existing attachments the boot is secured to the attachment through a connection point located at the toe, and the boot is guided by means of some ribs fixed to the ski, which are inserted into corresponding grooves in the sole of the boot.

These ribs provide an excellent guide only when the boot is pressed on the ski during sliding, but when the boot is lifted in thrusting or during the skater's step, there are strong lateral thrusts which may cause separation of the sole from the guide with twisting of the foot and heavy stresses on the attachment and boot, causing strain and/or breakage of the latter.

Moreover, with evolution of materials there is a tendency to make lighter skis, which will therefore become much weaker, above all where the attachment is fixed to the ski.

It is well known that all the attachments are secured to the ski with three screws, the holes of which are of a standard size.

When it is desired to replace the attachment, the screws have to be unscrewed and screwed up again, with a resulting weakening of the ski, caused by enlargement of the holes for the screws, at the point of greatest stress.

To regain a satisfactory fixture of the attachment to the ski, it is necessary to make use of special adhesives.

Another fact is that the special attachments are suitable for use only with their particular soles, thus creating the problem of non-interchangeability between the existing systems.

An attachment is therefore needed which due to its particular capability of miniaturization performs the function of adapting the sole and the various systems to each other.

Another factor which cannot be overlooked is the overall bulk. The existing attachments project to a smaller or greater extent from the toe of the boots and also laterally to the ski sometimes, thus causing problems of functioning, all the mechanisms being exposed to infiltration of snow and ice.

The invention is set forth as the idea of the solution in the main claim, while the dependent claims describe variants of the idea of the solution.

According to the invention, the shortcomings described above are overcome with the oscillation of the attachment on the upper part of the cross country ski by providing a support which extends frontally and below the sole of the boot.

This support extends mainly below the sole of the boot and is contained in a hollow within the sole; it can be fixed to the ski or be extracted, for instance by dismantling a suitable clamping means.

The support comprises below the boot two vertical wings, which are arranged along the boot and have the functions of a lateral guide and support.

On these wings is fitted a support and oscillation pivot substantially parallel to the surface of the ski and at a right angle to the lengthwise axis of the ski.

The lengthwise position of this oscillation pivot in relation to the front part of the boot determines the best arrangement for the skater's step or for the alternating step or for intermediate values between the these two extreme steps.

An oscillatory connection is fitted so as to be able to oscillate on the oscillation pivot. This oscillatory connector has a substantially L-shaped form and extends in front of the boot in a vertical direction and below the boot in a horizontal direction and can be lodged in a seating located in the sole.

In front of the oscillation pivot the oscillatory connector includes a frontal body to support the front part of the boot. This frontal body rises above the upper surface of the ski and forms a support for the sole of the boot.

A block is hinged on the frontal support body and, being resiliently resisted, serves to clamp between itself and the frontal support body the main anchorage pin included in front of the sole of the boot and forming one single body together with the sole.

Resilient spring means cooperating with the surface of the ski or with the surface of the support and at least with the frontal support body are included to resist the oscillation of the oscillatory connector resiliently.

The frontal support body is the front terminal part of the front body of the oscillatory connector.

At least one rear body forming part of the oscillatory connector and hinged to the front body is included in a retracted position in relation to the oscillation pivot.

This rear body is resiliently opposed in its oscillation in relation to the frontal support body.

The rear body includes an inclined slit with a terminal seating to lodge a secondary anchorage pin.

This secondary anchorage pin is parallel to the main anchorage pin and solidly fixed to the sole and passes advantageously through the seating provided below the sole.

The main anchorage pin and secondary anchorage pin may be connected to each other with a connection sunk in the sole of the boot.

The inclination of the slit is such that, as it approaches the surface of the ski, it becomes more distanced from the oscillation pivot.

Other frontal bodies anchored to the cited frontal body may also be included.

When the sole causes the oscillatory connector to rotate about the oscillation pivot, the front body rotates on its own pivot and tends to thrust the secondary anchorage pin towards the main anchorage pin, thus improving the anchorage of the boot to the attachment.

Figure 2:
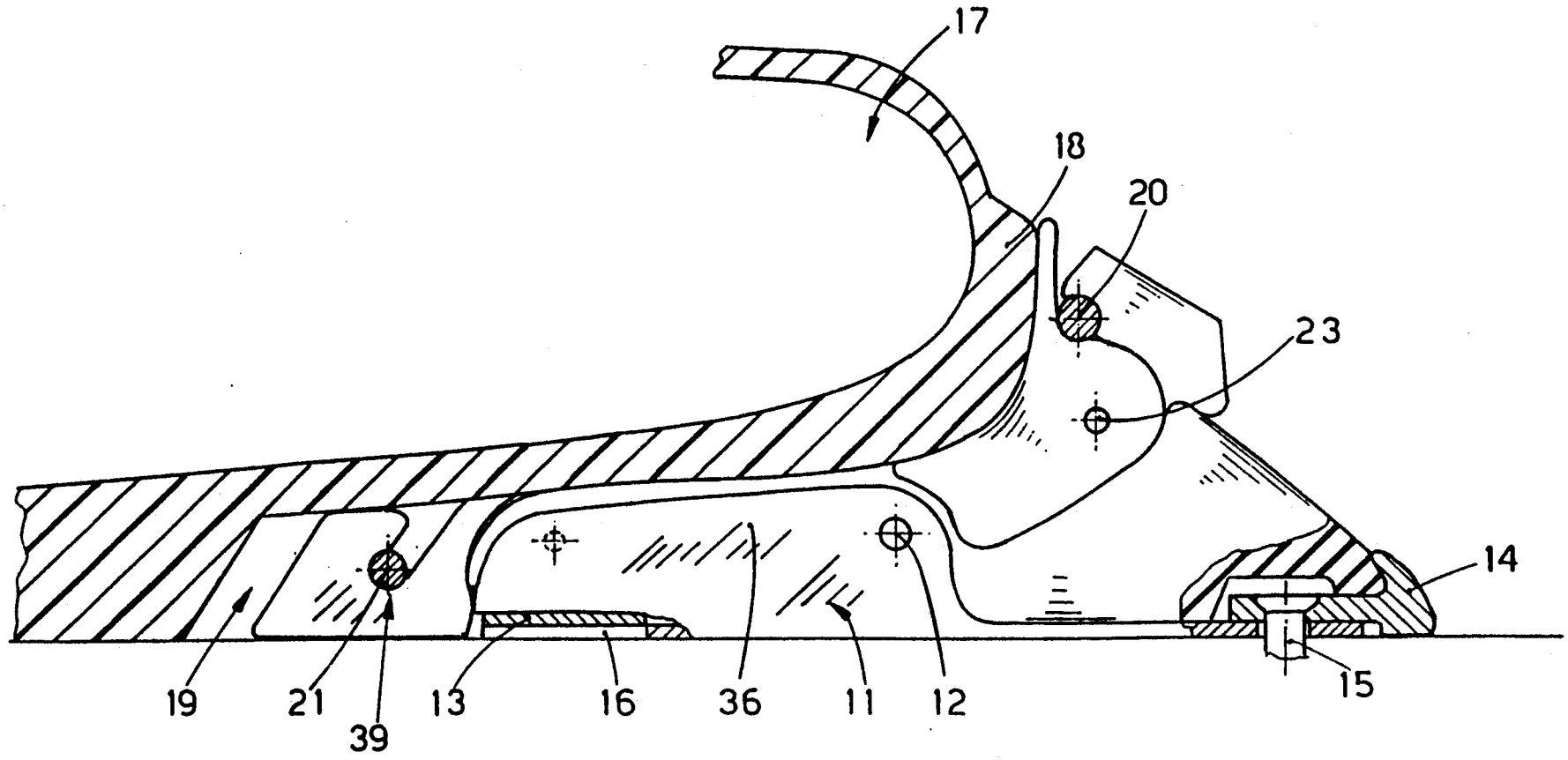
Figure 3:
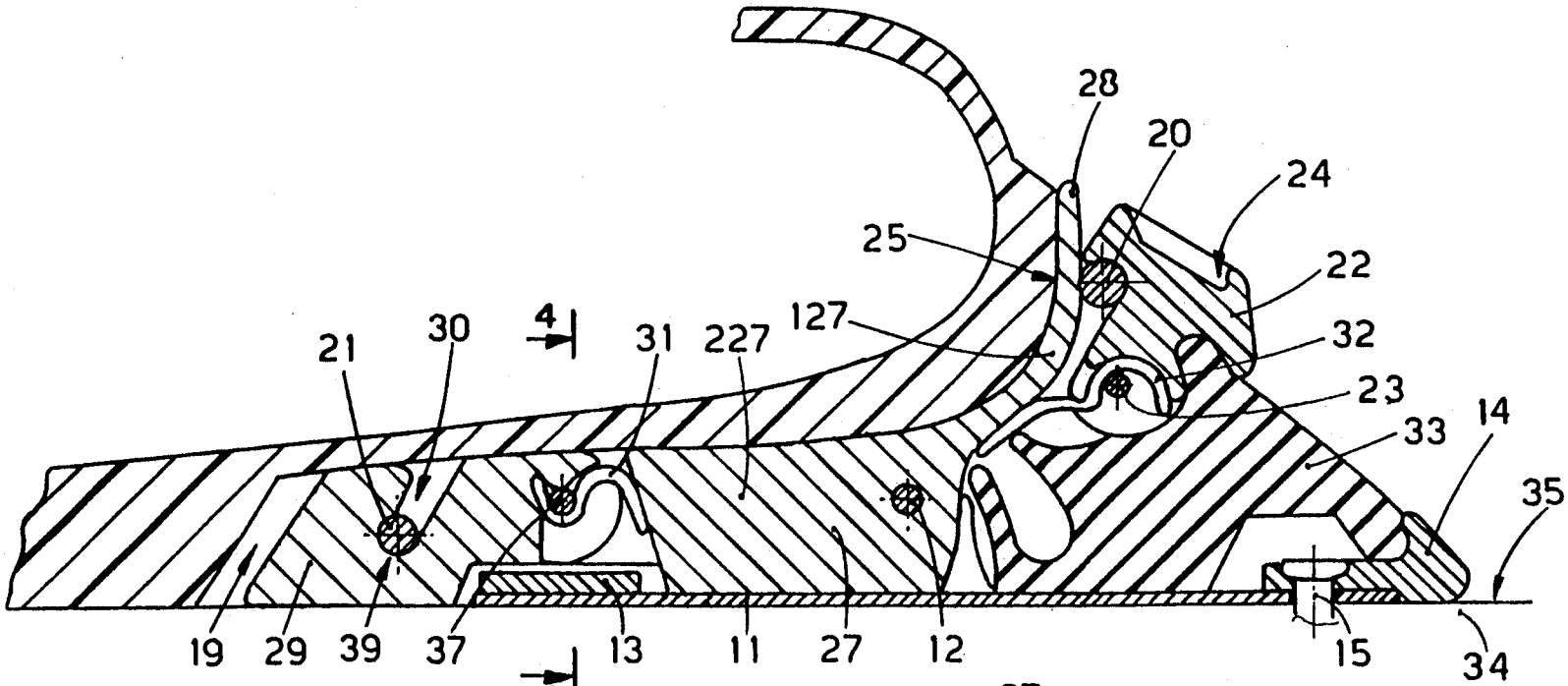
Figure 4:
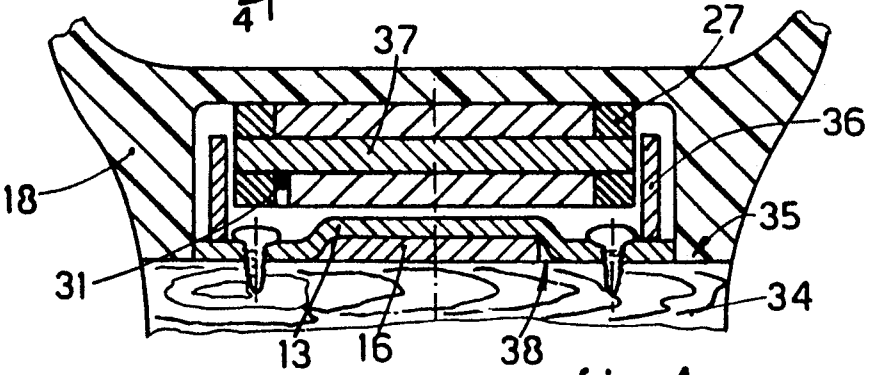
Figure 5:
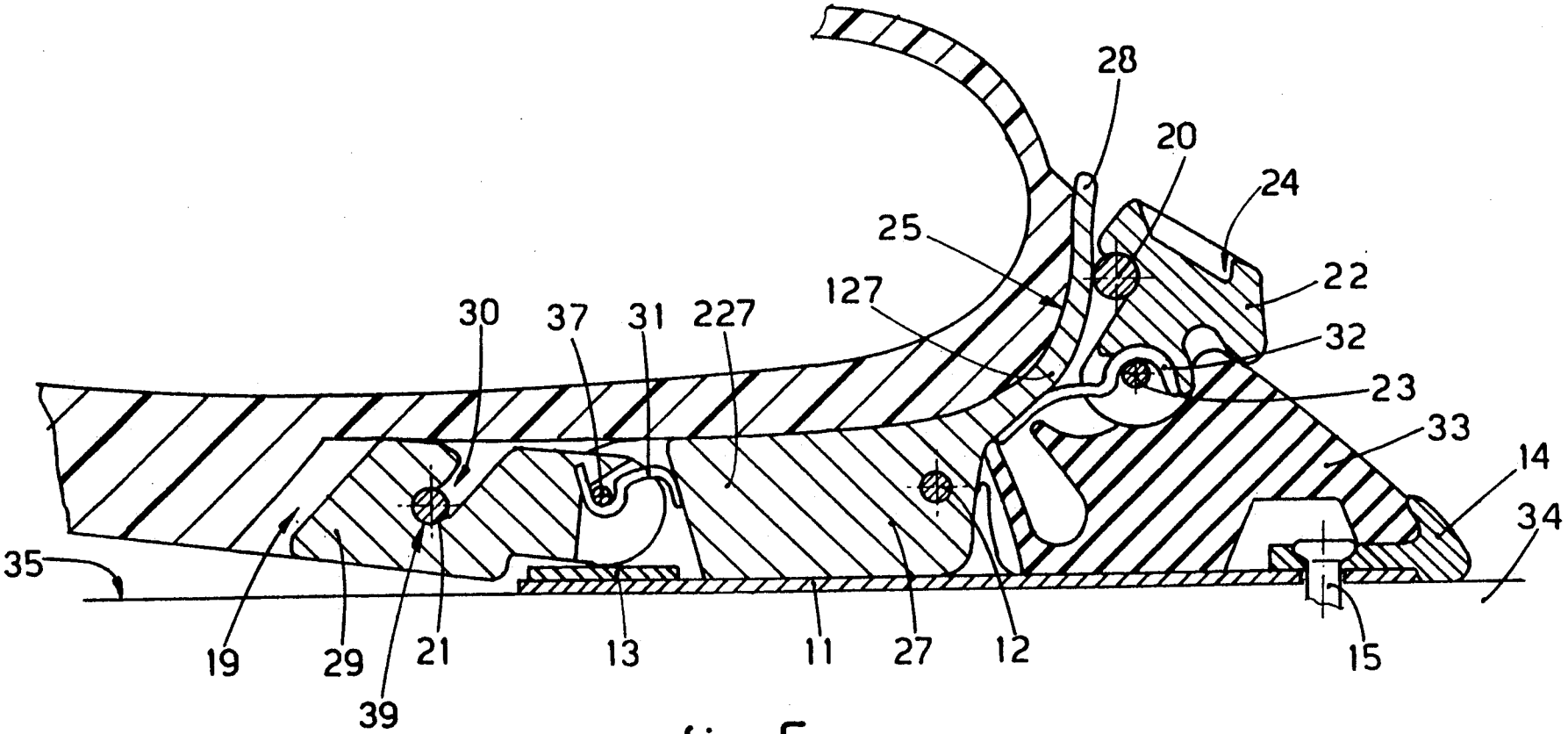
Figure 6:
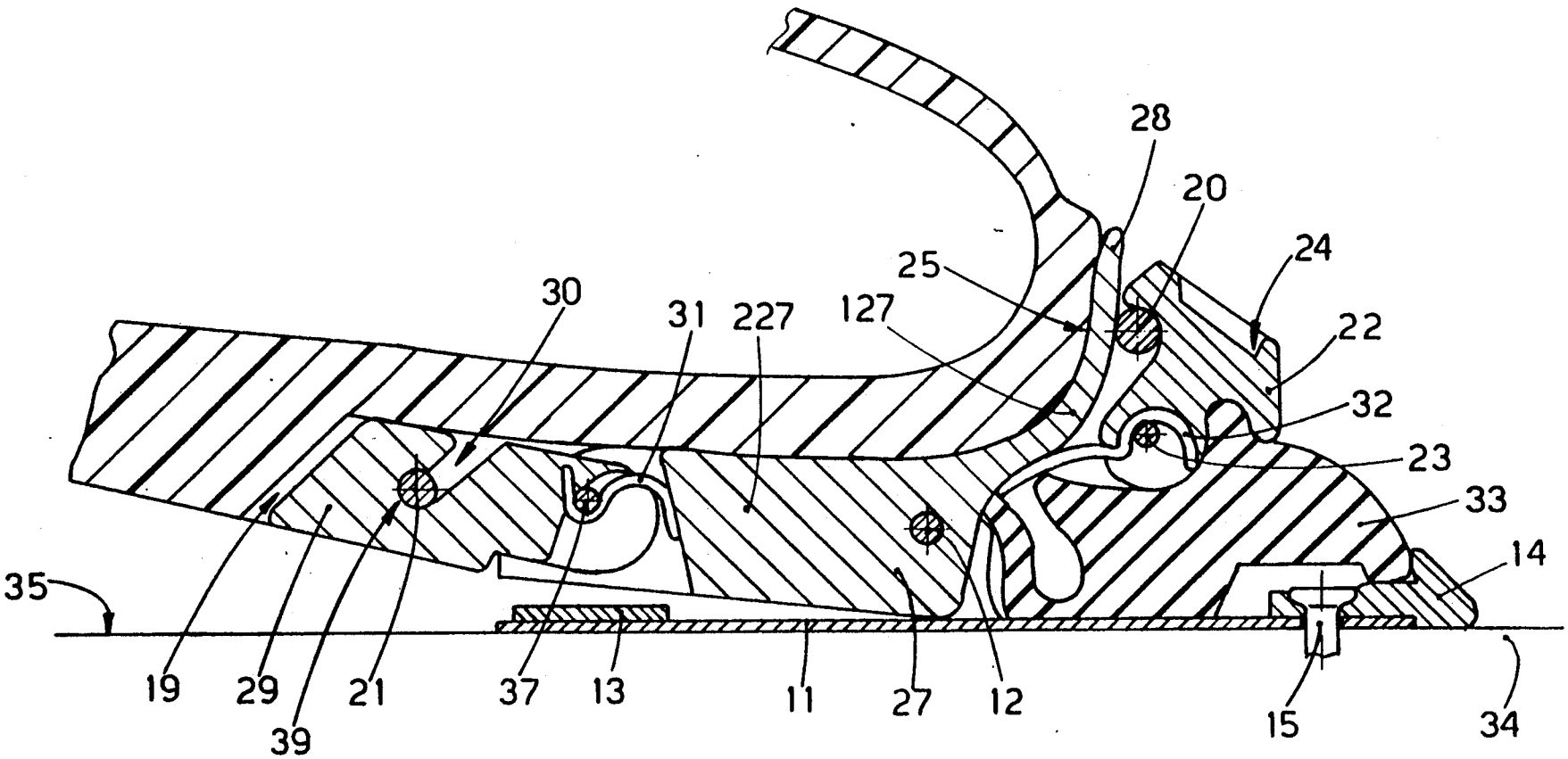

The attached FIGURES are given as a non-restrictive example and show the following: FIG. 1 gives a side view of an attachment according to the invention; FIG. 2 gives a side view of the attachment of FIG. 1 with the boot and sole cut away lengthwise; FIG. 3 shows the attachment of FIG. 1 cut away lengthwise; FIG. 4 shows a section of the attachment of FIG. 1 along the line A—A of FIG. 3; FIG. 5 shows a lengthwise section of the beginning of the movement of lifting the boot in connection with the attachment of FIG. 1; FIG. 6 shows a lengthwise section of the lifting of the boot in cooperation with the attachment according to the invention; FIG. *7a* is a diagram showing an arrangement wherein the oscillator pivot is positioned forwards; FIG. *7b* is a diagram showing an arrangement wherein the oscillator pivot is positioned in an intermediate position; FIG. *7c* is a diagram showing an arrangement wherein the oscillator pivot is positioned rearwards.

An attachment 10 is fitted to a cross country ski 34 above the upper support surface 35 of that ski 34. The attachment 10 comprises substantially a support 11 equipped with lateral wings 36 extending below the ski boot and positioned advantageously within a seating 19 included in the sole of the boot, as shown in FIG. 2.

The wings 36 comprise at their front end an oscillation pivot 12, to which an oscillatory connector 26 (see FIG. 1) is anchored so as to be able to oscillate in a vertical plane along the ski.

The wings 36 form also a lateral guide for the oscillatory connector 26, which has a substantially L-shaped conformation with the vertex of the L coinciding with the axis of the oscillation pivot 12.

In the embodiment shown, the oscillatory connector 26 consists of at least two bodies, which are respectively a front body 27 anchored to and able to oscillate on the oscillation pivot 12 and at least one rear body 29 anchored to and able to oscillate on the front body 27 by means of a second pivot 37, as shown in FIGS. 3–6.

The front body 27 comprises a first leading side 127 extending vertically above the ski 34 and a second lower trailing side 227 extending substantially parallel to the ski 34.

In the embodiment shown the rear body 29 is anchored terminally to the trailing side 227 of the front body 27.

The rear body 29 includes an inclined slit 30, which becomes farther distanced from the oscillation pivot 12 as it approaches the upper support surface 35 of the ski 34.

A seating 39 is located at the inner end of the slit 30 and accommodates a secondary anchorage pin 21. Thrust spring means 31 are included between the front and rear bodies 27–29 and tend to keep those bodies 27–29 aligned and cooperating with the upper surface 35 of the ski 34.

A resilient extension of the front body 27 may be provided instead of the rear body 29 and will include the seating 39 for the secondary anchorage pin 21.

As described above, the front body 27 is supported on and can oscillate on the oscillation pivot 12 and is guided laterally by the wings 36 of the support 11.

The lengthwise position of the oscillation pivot 12 in relation to the toe of the boot 17 conditions the type of preferred step to be carried out. Examples of positioning are shown in FIGS. 7*a*, 7*b* and 7*c*.

The oscillation pivot 12 may be positioned further forward or further backward, depending on the specific type of step which the specific installation of the attachment is intended to assist.

If the support 11 together with the relative oscillatory connector 26 is replaced, or if only the oscillatory connector 26 is replaced, it is possible to change the arrangement of the ski speedily.

Figure 7A:
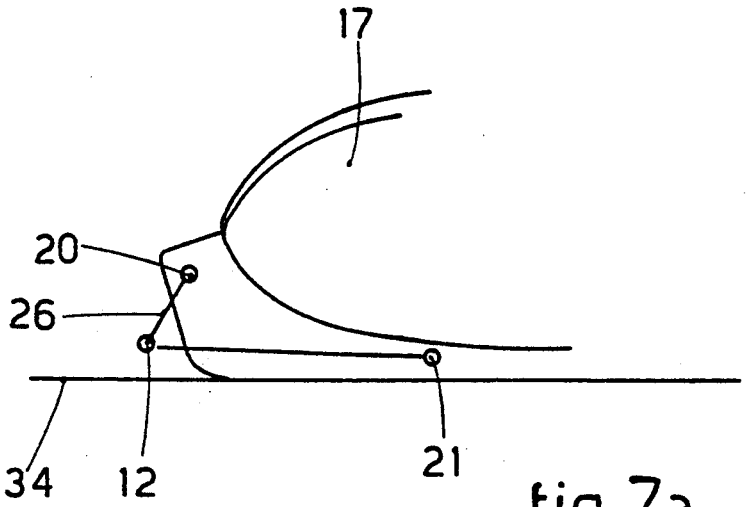
Figure 7B:
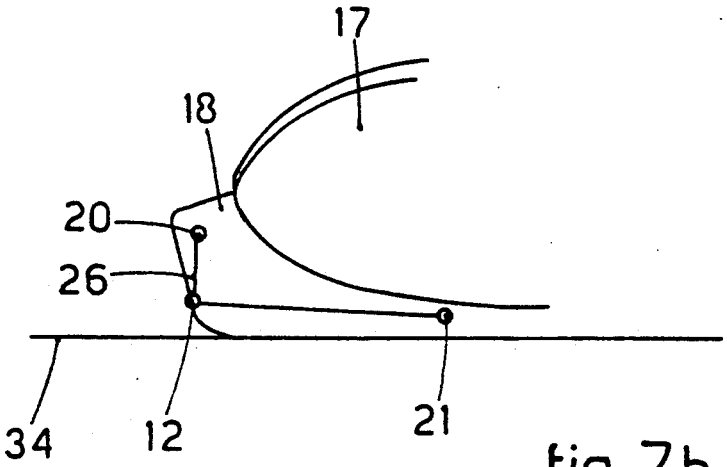
Figure 7C:
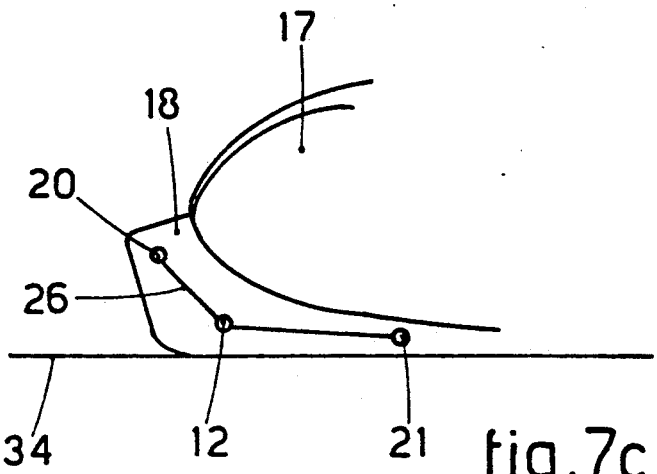

Thus the embodiment of FIG. 7*a*, in which the oscillation pivot 12 is positioned forwards, is advantageous for the alternating step, whereas the embodiment of FIG. 7*c*, in which the oscillation pivot 12 is positioned backwards and approximately under the boot 17, is advantageous for the skater's step.

As we said above, the sole 18 in the example shown has at its front and below itself a seating 19 with which the main anchorage pin 20 and secondary anchorage pin 21 cooperate.

In this example both the anchorage pins 20–21 pass through the seating 19 and secure the boot 17 to the attachment 10.

Rigid lateral connecting elements may be included between the main anchorage pin 20 and the secondary anchorage pin 21; if so they will be sunk in the sole 18 and will reinforce the anchorage pins 20–21 and also the front part of the sole 18.

The front body 27 rises at its front to provide a frontal support edge 28 on which the frontal part of the sole 18 rests with its seating 19.

In a high portion of the first leading side 127 of the front body 27, where the frontal support edge 28 is located, there is a slot 25 which accommodates the main anchorage pin 20, e.g., as shown in FIG. 1, whereas the secondary anchorage pin 21 is lodged in the inclined slit 30 of the rear body 29 or else, according to the variant, of the resilient extension of the second trailing side 227 of the front body 27.

The slot 25 is provided partly in the frontal support edge 28 and partly in a block 22.

The block 22 is thrust resiliently against the frontal support edge 28 by a thrust spring 32 and is supported by the first leading side 127 of the oscillatory connector 26 in such a manner that it can oscillate on a pin 23, as shown in FIGS. 3, 5 and 6. Thus, the block 22 is supported by the front body 27 by means of the pin 23.

The block 22 comprises an actuation notch 24 suitable to apply the force that causes the block 22 to rotate about the pin 23, thus opening the slot 25 and freeing the main anchorage pin 20.

Contrast spring means are included between the support 11 and the first leading side 127 and cooperate at least with the first leading side 127 on the front body 27.

In the example shown the contrast spring means are thrust spring means 33, which consist of a resilient material and rest on the base of the support 11, acting in this case against the front body 27 and the block 22.

The support 11 is secured at its front by a clamping cap 14, which serves also to oppose and lodge the contrast thrust spring means 33.

By removing the contrast thrust spring means 33 it is possible to have access to a screw 15 which in this example secures the clamping cap 14. When the clamping cap 14 is removed, the support 11 can be withdrawn by being moved forwards along the attachment 10.

In fact, as shown in FIG. 4 the support comprises at its rear end a connection plate 16, which is inserted into a seating 38 formed by a positioner bracket 13, which is secured to the upper side 35 of the ski 34 by screws.

The connection plate 16 may be sunk in the ski 34 during construction of the latter and the seating 38 may be produced in this way.

In the example shown, the wings 36 of the support 11 cooperate with the upper surfaces of the positioner bracket 13 in clamping and stiffening the assembly.

Accurate workmanship of the seating 38 and connection plate 16 makes possible very precise lateral anchorage, while lengthwise anchorage is provided by the frontal screw 15, which secures the clamping cap 14.

The rear body 29, which can oscillate on a pivot 37, is included, as we said earlier, on the terminal part of the second lower trailing side 227 of the front body 27; a thrust spring means 31 operates between the front 27 and rear 29 bodies.

When the boot 17 is positioned on the ski 34 and there is no action on a vertical plane (see FIG. 3), the front body 27 rests on the support 11, whereas in this case the rear body 29 rests on the upper side 35 of the ski 34.

The sole 18 with its own seating 19 rests on the frontal support edge 28 or else on the front body 27 and rear body 24, while in the situation of FIG. 4 the sole rests laterally also on the ski 34.

When the vertical movement of the boot 17 begins and before the oscillatory connector 26 starts rotating about the oscillation pivot 12 by overcoming the resistance of the contrast thrust spring means 33, the rear body 29 (see FIG. 5) rises slightly.

By rising, the rear body 29 thrusts the secondary anchorage pin 21 further into the seating 39 in the slit 30 since the seating 39 tends to be displaced, thus reducing the distance between the slot 25 of the main anchorage pin 20 and the terminal seating 39 of the inclined slit 30.

Thus, while the boot 17 is rotating vertically, the terminal seating 39 for the secondary anchorage pin 21 tends to approach the slot 25 that lodges the main anchorage pin 20.

In this way a better anchorage and stiffening of the boot 17 and a better frontal and lateral engagement of the same 17 are achieved.

While the boot 17 continues rotating vertically (see FIG. 6), the front body 27 starts rising, whereas the frontal support edge 28 is lowered since the resistance of the contrast thrust spring means 33 is overcome.

To dismantle the assembly it is enough to rest the sole 18 on the ski 34, act on the actuation notch 24 to open the slot 25 and extract the boot 17 vertically, so that the anchorage pins 20 and 21 leave their respective slot 25 and terminal seating 39.

If the attachment 10 has to be dismantled, it is enough in this case to remove the contrast thrust spring means 33, unscrew the frontal screw 15, remove the clamping cap 14 and withdraw the support 11 with the oscillatory connector 26 above it.

In this way it is easy to replace the attachment 10 with another attachment in which the oscillation pivot 12 is positioned geometrically further forward or backward than in the attachment used previously.

The fitting and dismantling of the contrast thrust spring means 33 are very simple and easy.

Variants are possible, for instance, by providing on the rear body 29 further rear bodies, each of which is anchored to the preceding rear body and comprises an inclined slit 30 cooperating with further secondary anchorage pins, the whole serving for a further control of the boot.

I claim:

1. A combination which is suitable to connect a ski boot to a surface of a cross country ski, comprising:

an integrated attachment comprising a support having a pair of opposing wings; an oscillator pivot supported between said pair of opposing wings, said oscillator pivot being positionable parallel to said surface of said cross country ski and perpendicular to a longitudinal direction of said cross country ski; an oscillatory connector supported on said oscillator pivot and having a frontal body portion extending before and behind said oscillator pivot, said oscillatory connector having an I-shaped form with its vertex on an axis of said oscillation pivot, wherein said oscillatory connector allows said ski boot to oscillate about said oscillation pivot vertically with respect to said cross country ski; and contrast spring means acting on a frontal side of said frontal body to oppose oscillation of said oscillatory connector; and a ski boot bearing a main anchorage pin, said main anchorage pin being resiliently clamped in a slot in said integrated attachment.

wherein said pair of opposing wings extend longitudinally parallel to said oscillatory connector and below a sole of said ski boot and within a seating therein towards a heel of said ski boot and are positionable so as to have a longitudinal direction parallel to said longitudinal direction of said cross country ski and extend vertically perpendicular to said surface of said cross country ski so as to form a lateral guide for said oscillatory connector.

2. A combination according to claim 1, wherein said oscillatory connector has a first leading portion positionable so as to extend substantially vertical to said cross country ski and a second lower trailing portion positionable to extend substantially parallel to said longitudinal direction of said ski, said oscillation pivot being located at a vertex joining said first leading portion and said second lower trailing portion; and wherein said first leading portion has a frontal support edge that supports a front part of a sole of said ski boot.

3. A combination according to claim 2, wherein said first leading portion and said second trailing portion of said oscillatory connector form an angle at said vertex which is determined according to a predominant athletic action.

4. A combination according to claim 2, wherein said slot which resiliently clamps said main anchorage pin is provided in said first leading portion of said socillatory connector and clamps said main anchorage pin by cooperating with a temporary fixture block.

5. A combination according to claim 4, wherein said temporary fixture block is anchored to said integrated attachment such that it can oscillate, while resiliently opposed, on a second pivot and is supported by said first leading portion of said socillatory connector.

6. A combination according to claim 1, wherein said oscillatory connector further comprises at least one resiliently opposed rear body attached to a rear portion of said frontal body portion and fitted so as to be able to oscillate behind said frontal body portion.

7. A combination according to claim 1, wherein said oscillatory connector further comprises a rear body with a controlled resilience which is included behind said frontal body portion.

8. A combination according to claim 6, wherein said rear body includes an inclined slit having a terminal seating and said ski boot bears a secondary anchorage pin, wherein said terminal seating is able to lodge said secondary anchorage pin.

9. A combination according to claim 8, wherein said inclined slit is open at its upper end and becomes more distant from said oscillation pivot as it extends towards said terminal seating at its lower end.

10. A combination according to claim 8, wherein said secondary anchorage pin is an integral part of a sole of said boot.

11. A combination according to claim 1, further comprising a removable clamping means engaging said contrast spring means at a front portion thereof and which is able to be detachably connected to said cross country ski.

12. A combination according to claim 1, wherein said integrated attachment further comprises a connection plate positionable so as to extend parallel to said longitudinal axis of said ski and designed to cooperate with a seating formed by a positioner bracket on said cross country ski.

* * * * *